US007699177B2

(12) United States Patent
Craig

(10) Patent No.: US 7,699,177 B2
(45) Date of Patent: Apr. 20, 2010

(54) METHOD AND APPARATUS FOR WASHING SAND

(75) Inventor: Gregory C. Craig, Vernon Hills, IL (US)

(73) Assignee: Parkson Corporation, Fort Lauderdale, FL (US)

( * ) Notice: Subject to any disclaimer, the term of this patent is extended or adjusted under 35 U.S.C. 154(b) by 0 days.

(21) Appl. No.: 11/687,312

(22) Filed: Mar. 16, 2007

(65) Prior Publication Data

US 2007/0215525 A1 Sep. 20, 2007

Related U.S. Application Data

(60) Provisional application No. 60/783,402, filed on Mar. 20, 2006.

(51) Int. Cl.
*B03B 5/62* (2006.01)
*B03B 5/66* (2006.01)

(52) U.S. Cl. ..... 209/159; 209/161

(58) Field of Classification Search ..... 209/159, 209/158, 161; 210/208
See application file for complete search history.

(56) References Cited

U.S. PATENT DOCUMENTS 4,061,790 A * 12/1977 Cole, Jr. ..... 426/303
4,124,497 A * 11/1978 Hulegard ..... 209/3
4,363,697 A * 12/1982 Markham et al. ..... 162/19
5,167,375 A * 12/1992 Datta ..... 241/46.02
5,531,034 A * 7/1996 Mentz ..... 34/179
5,641,397 A * 6/1997 Grienberger ..... 210/97
5,667,074 A * 9/1997 Reali et al. ..... 209/224
5,811,016 A 9/1998 Zierler
6,109,478 A * 8/2000 Blenkinsop et al. ..... 222/77
7,137,759 B1 * 11/2006 Ambs ..... 406/55
7,318,527 B2 * 1/2008 Branner ..... 209/1
2002/0124780 A1 * 9/2002 Promuto ..... 110/342

OTHER PUBLICATIONS

Tru-Grit Manure Sand Saver Brochure, Parkson Corporation Copyright 2003, http://www.parkson.com/parksonAssets/Brochures/Manure-Sand-Saver.pdf.*

* cited by examiner

*Primary Examiner*—Patrick Mackey
*Assistant Examiner*—Mark Hageman
(74) *Attorney, Agent, or Firm*—Gilberto M. Villacorta; Matthew J. Kremer; Foley & Lardner LLP

(57) ABSTRACT

A disclosed sand washing apparatus may be used for separating organic material from a mixture comprising sand and organic material. The apparatus may comprise: a wash chamber for accepting a mixture comprising sand and organic material, an agitator, a collection chamber, and a conveyor configured to transport sand away from the collection chamber. The disclosed method for recovering sand from a mixture comprising sand and organic material may comprise the steps of: introducing the mixture into a chamber, allowing organic material to ascend while allowing sand to descend, subjecting a portion of the descending sand to a turbulence that creates a lifting action, and recovering sand that has descended past the turbulence.

23 Claims, 7 Drawing Sheets

METHOD AND APPARATUS FOR WASHING SAND

CROSS-REFERENCE TO RELATED PANTENT APPLICATIONS

This application claims priority to U.S. Provisional Application No. 60/783,402 filed on Mar. 20, 2006, the disclosure of which is incorporated by reference herein in its entirety.

BACKGROUND

The present disclosure relates to a method and apparatus for washing sand that is contained in wastewater. In particular, the present invention relates to a method and apparatus for separating sand, which is used for bedding animals, such as cows, from organic material for easy disposal of the organic materials and the reuse of the sand.

There has been a practice in the dairy industry to use sand as a bedding for animals, such as cows. The use of sand as a bedding material for cows has several advantages over the traditionally used chopped straw, sawdust or wood shavings. Some of the benefits include improved udder health, increased cow comfort, cleaner cows, improved traction and lower cost. One drawback to the use of sand is the significant handling and storage problems associated with the resulting mixture of sand and organic material, such as manure.

After the sand has been used as bedding, a mixture of sand and other particles is collected. This mixture from the floor of a dairy barn, for example, can be made up of (1) sludgy, hard brown organic matter; (2) organic matter in the form of fibrous or seedy undigested feed particles; (3) outside contaminants such as hair, tails, hoof particles, etc., and (4) sand. The object is to separate the sand from all the other constituents so that it is clean enough to reuse.

The related art has shown an assortment of separation systems used in the dairy, mining and petroleum refining industries. Some separation systems, such as screening and dissolved air floatation, are ineffective for use in separating manure and sand. For example, the dissolved air floatation method is ineffective because the minute bubbles are unable to float the large, coarse manure particles to the top of the tank for removal. Screening is also ineffective due to the similarities in the particle size distributions of the bedding sand and the manure.

In one type of separation system, the sand is rinsed together with wastewater to remove the harmful organic material. In this case, the sand is collected in a collecting reservoir with organic material and then pumped into a sand separator. This sand separator consists essentially of a vertical funnel-shaped container having an overflow. The wastewater with the organic material exits the overflow while the sand exits the container through a discharge opening at the bottom of the container. A discharge conveyor, which is typically a screw conveyer, is provided beneath the discharge opening to convey the sand at an upward angle so that the exit of the discharge conveyor is located above the height of the overflow. A rotating stream is created inside the container in which the characteristically lighter inorganic materials are displaced upward while the characteristically heavy sand sinks downward toward the discharge conveyor. The upward movable organic material is removed from the container together with the overflowing wastewater. The sand, which settles in a region at the conveyor bottom, can be removed by the discharge conveyor with the accompanying draining of the sand because the discharge end of the conveyor is located higher than the container overflow. For the discharging of sand, a stepwise drive for the discharge conveyor is recommended to insure sufficient settling time for significant separation of the sand and organic materials after the introduction of the water. A drawback of this method of separating sand consists primarily in that the discharged sand is still loaded to some extent with organic material which excludes a further use of the sand, e.g., as bedding or as a bulk material in construction.

One attempt to correct these problems has been presented in U.S. Pat. No. 5,811,016, issued Sep. 22, 1998, (hereinafter referred to as the '016 Patent). The '016 patent describes a method and an apparatus for removing sand from organic material involving a water-filled container in which the organic material flows upward with the rinsing water to an overflow while the sand sinks downward toward a discharge conveyor connected to the container from beneath. The sand is discharged after a certain settling period. The separation of the sand with the organic material was achieved by stirring the settled sand while simultaneous rinsing the sand with fresh water delivered to the container's bottom region.

The above method and apparatus of the '016 patent does have some drawbacks. For example, the sand, which settles in the bottom region of the container, forms a stop for the organic material to prevent the organic material from reaching the inlet of the discharge conveyor. Thus, there is a requirement that the height of the sand deposit in the container bottom region does not fall below a minimum dimension. As a result, to insure the obtainment of such a vertical sand cake, the sand can only be discharged in an amount which at most corresponds to the excess of sand over the minimal height.

SUMMARY

A sand washing apparatus of the present application can used for separating organic material from a mixture comprising sand and organic material. In one embodiment of the sand washer, the apparatus may comprise a wash chamber, an agitator, a collection chamber, and a conveyer. The wash chamber can be in the shape of a funnel, which accepts the mixture comprising sand and organic material. The wash chamber may include a lower portion in the shape of a cylinder or other similar shape through which sand can descend in a downward direction and rinsing water can flow in an upward direction. The agitator can be place in the wash chamber so that at least some portion of it is positioned within the lower portion of wash chamber and is configured so that its rotation creates a lifting action tending to force at least a portion of sand descending through or already present in the cylinder to flow in an upward direction. The collection chamber can be positioned below the wash chamber for collecting sand that has descended past the cylinder. The conveyor is configured to transport the washed sand away from the collection chamber.

In another embodiment of the sand washing apparatus, the agitator may be selected from a screw, a shaft equipped with paddled arms, or a combination thereof. In the case of the use of a screw for the agitator, several configurations may be used. For example, the agitator may comprise a shaftless screw or a screw having two or more flights. If the screw has flights, those flights may be smooth flights; cut flights; cut and folded flights; flights with a predetermined pitch, outer diameter, and root diameter; or any combination thereof. In the case of the use of a shaft equipped with paddle arms as the agitator, the paddled arms may further be characterized as having a predetermined or adjustable pitch.

In addition, the sand washing apparatus may comprise a variable speed motor for driving the agitator, one or more inlets for the introduction of water, one or more inlets for the introduction of the mixture comprising sand and organic material, one or more outlets for the removal of wastewater comprising water and organic material, and/or a weir for the removal of wastewater comprising water and organic material. In one configuration of the sand washing apparatus, the one or more inlets may comprise one or more chutes, whose ends extend below the level of the one or more outlets. In a configuration with the weir, the one or more inlets may comprise one or more chutes whose ends extend below the level of the weir.

In regards to another embodiment, the sand washing apparatus may comprise a conveyor, which is equipped with a shaftless spiral. In one example, the shaftless spiral may be driven by a conveyor motor. In another example, a control module may link the operation of the conveyor motor with the speed of the variable speed motor.

In another embodiment of the present invention, a method of recovering sand from a mixture comprising sand and organic material is disclosed. Such a method may comprise the steps of: introducing a mixture comprising sand and organic material into a water-filled chamber having a net flow of water in an upwardly direction; allowing the organic material from the mixture to ascend in a net upwardly direction and allowing the sand from the mixture to descend in a net downwardly direction; subjecting at least a portion of the descending sand to a turbulence that creates a lifting action tending to force sand encountering the turbulence to flow at least temporarily in an upwardly direction; and recovering sand that has descended past the turbulence.

According to another embodiment, there can be a step of transporting the recovered sand away from the water-filled chamber.

In yet another embodiment, the step of subjecting at least a portion of the descending sand to a turbulence includes the step of impacting the granules of sand mechanically against another object, such as other sand granules, paddles, plates, flights, or any combinations thereof. For example, the turbulence can be generated by an agitator. The step of impacting may break up agglomerates of sand granules and organic material and/or may scrub the organic material away from the sand.

In one embodiment in which the turbulence is generated by an agitator, the agitator can rotate about a vertical or horizontal axis. In another embodiment, the agitator may comprise a screw, a shaft equipped with paddled arms, or a combination thereof. If the agitator is a screw, the screw may be equipped with smooth flights, cut flights, cut and folded flights, or any combination thereof.

In one example of the method of recovering sand, the turbulence can be positioned about the center axis of the chamber causing at least a portion of sand encountering the turbulence to flow in an upwardly direction while allowing at least a portion of sand not encountering the turbulence to flow in a downwardly direction.

It is to be understood that both the foregoing general description and the following detailed descriptions are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Various embodiments of the present invention will be explained with reference to the accompanying drawings.

Figure 1:
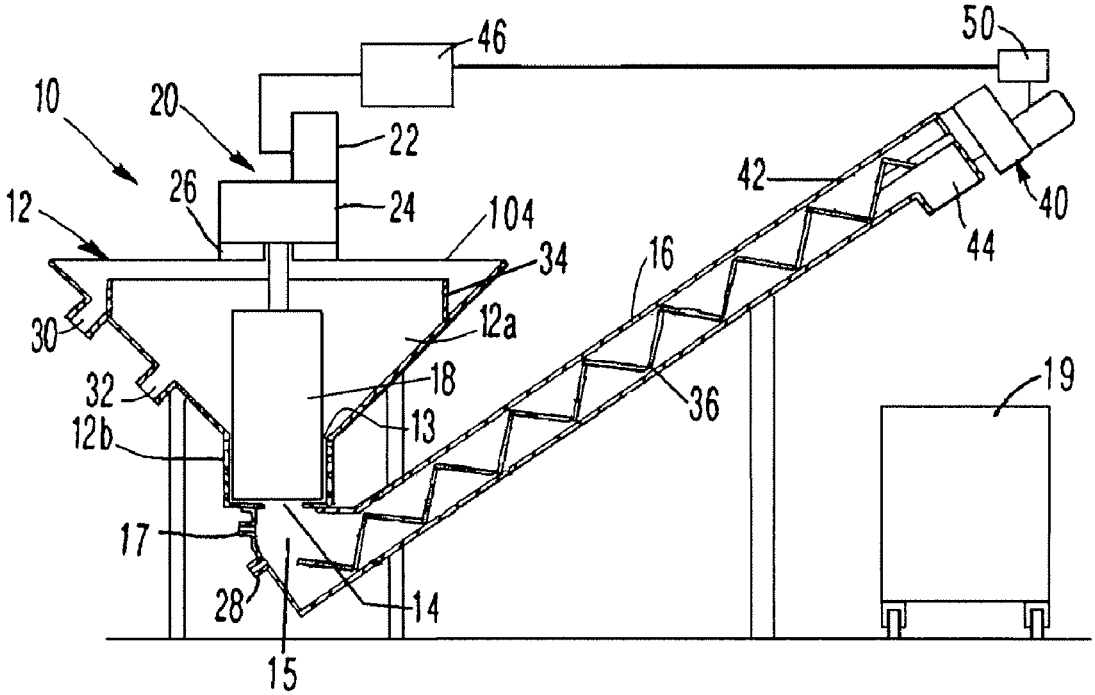
FIG. 1 shows a schematic structure of the sand washing apparatus according to one of the embodiments of the present invention.

FIG. 1 shows a schematic structure of the sand washing apparatus 10 according to one of the embodiments of the present invention. The embodiment of FIG. 1 shows the basic apparatus of the sand washing apparatus 10, which may comprise a wash chamber 12, a collection chamber 15, a discharge conveyer 16, and an agitator 18. Each of these components and their auxiliary components will be described below.

The wash chamber can be a vertical container in which the mixture of sand and organic material is inputted, separated, and discharged. The wash chamber can be in the shape of a funnel with an upper conical section 12*a* that is opened at the top 104, a lower cylindrical section 12*b*, and a bottom discharge opening 14. To be the shape of a funnel according the present application means any shape that has larger volume connected to a smaller volume by way of an opening between the two volumes. For example, FIG. 1 shows a larger volume in the form of the upper section 12*a*, a smaller volume in the form of the lower section 12*b*, and the two sections are connected through an opening 13. In addition, the wash chamber can comprise one or more inlets for the introduction of fresh water, which is used for the washing of the sand. For example, FIG. 1 shows a fresh water inlet near the discharge opening 14 of the wash chamber 12. In this case, there is provided a fresh water inlet conduit 28 through which fresh water can be pumped through the bottom discharge opening 14. Optionally but not required, pressurized air can be supplied through the pressure air conduit 17 to make the rinsing process with the fresh water more effective.

Figure 2:
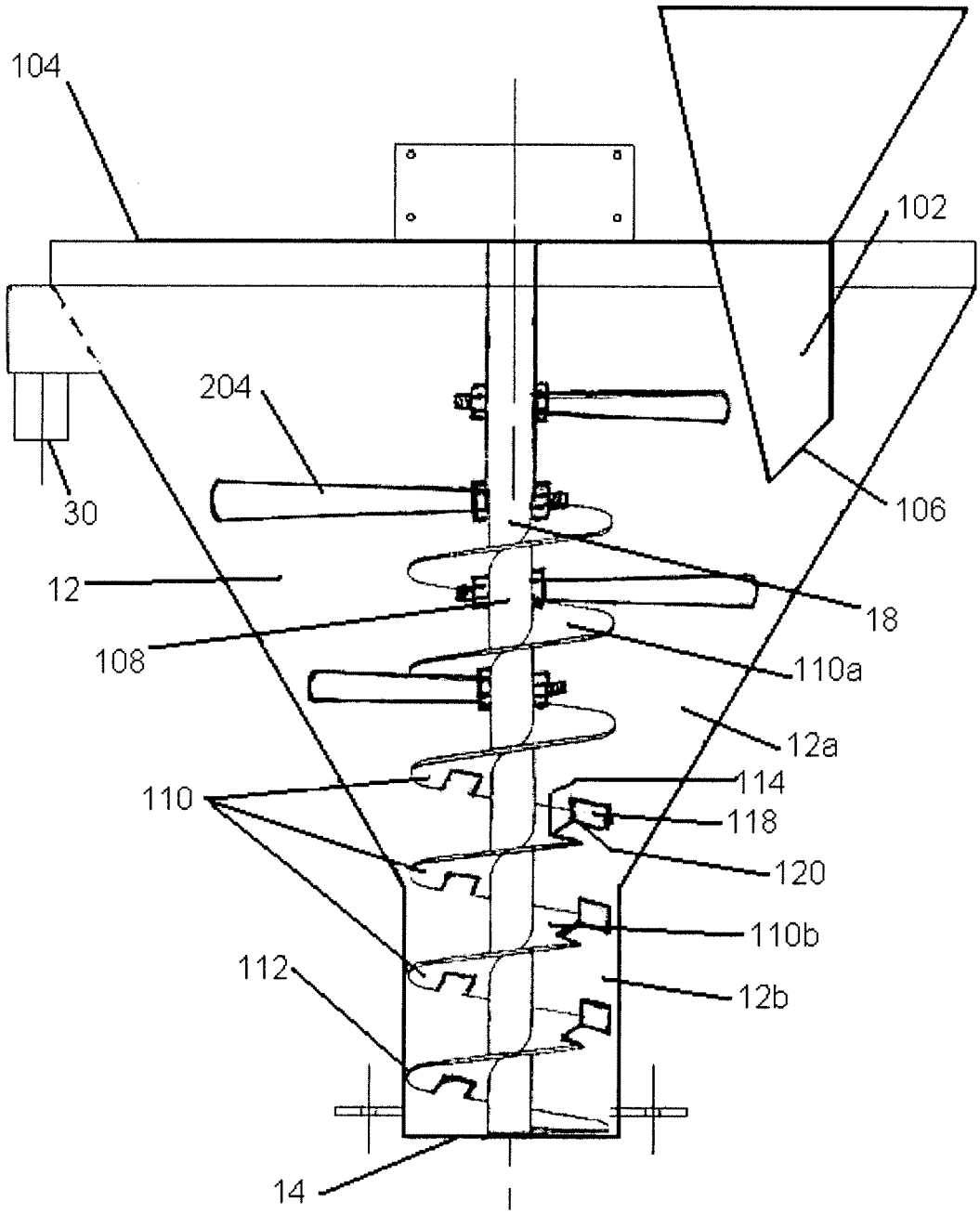
FIG. 2 shows a wash chamber and an agitator according to one embodiment of the present invention.
Figure 3A:
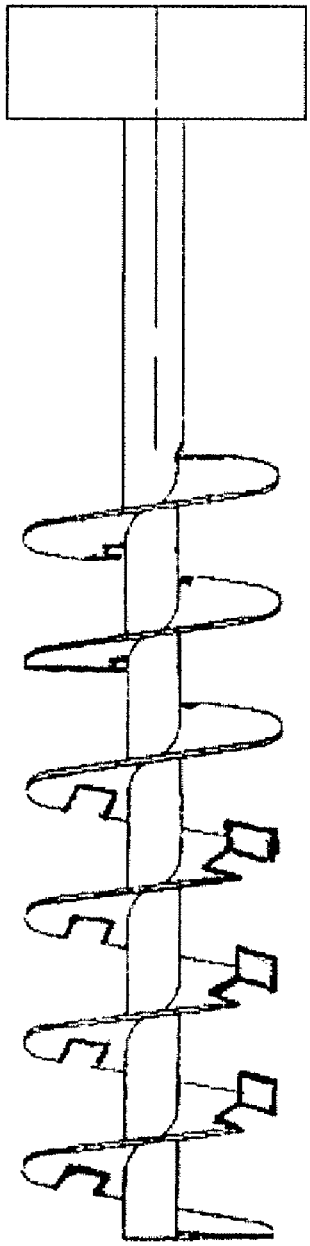
FIGS. 3(*a*)-3(*j*) show various agitators according to various embodiments of the present invention.
Figure 3B:
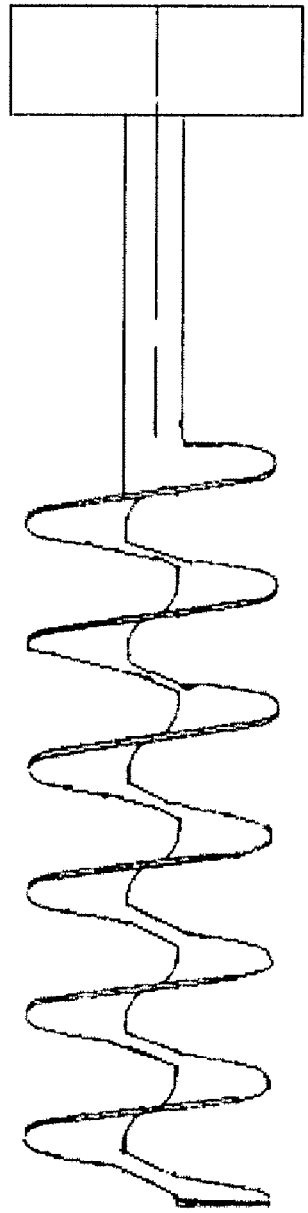
Figure 3C:
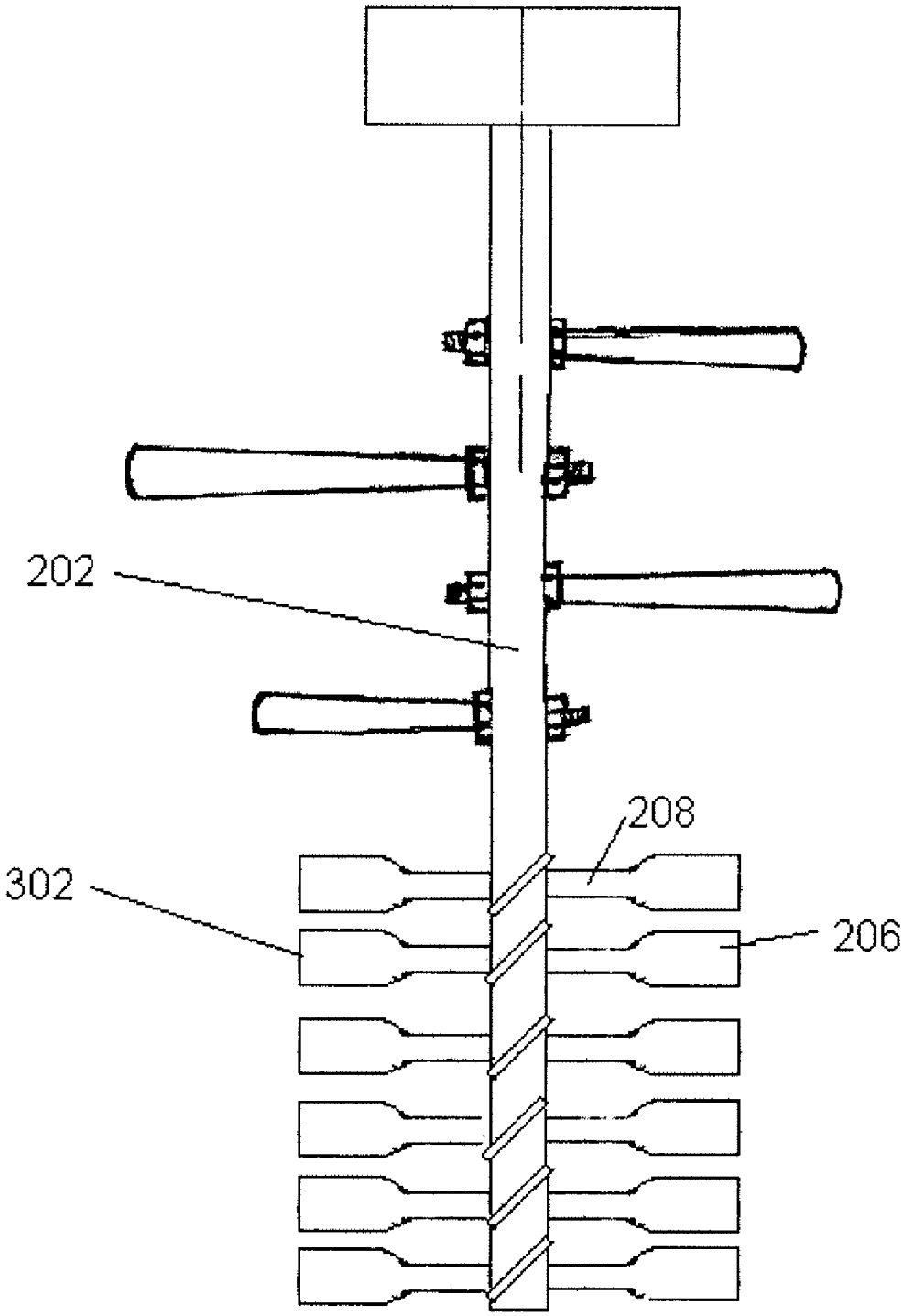
Figure 3D:
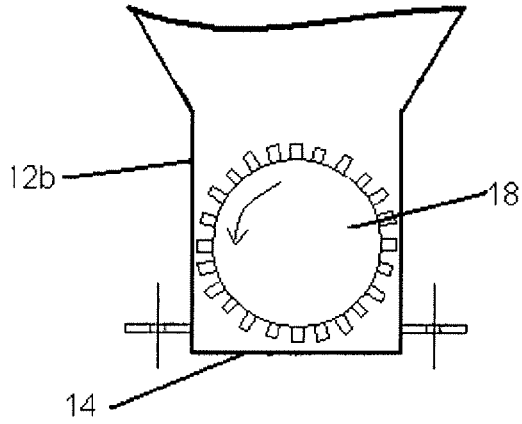
Figure 3E:
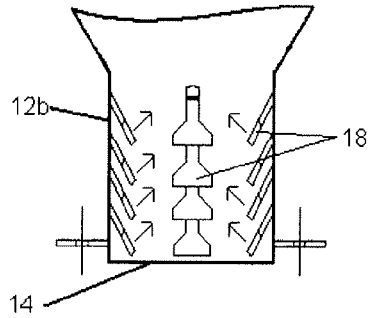
Figure 3F:
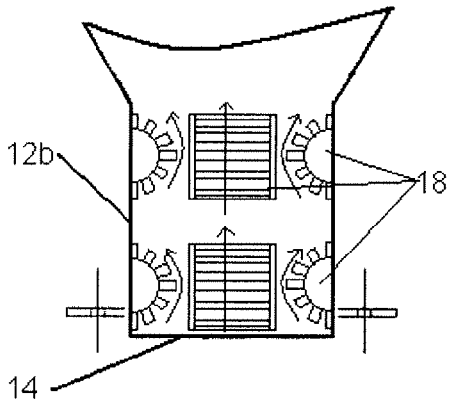
Figure 3G:
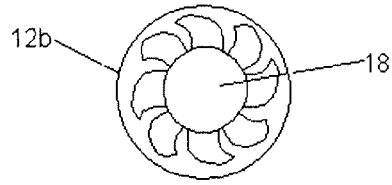
Figure 3H:
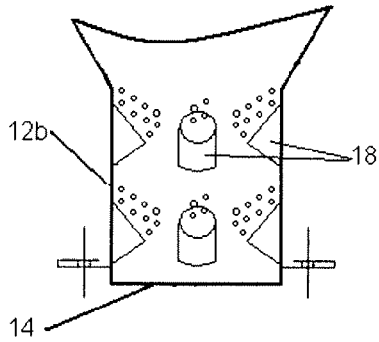
Figure 3I:
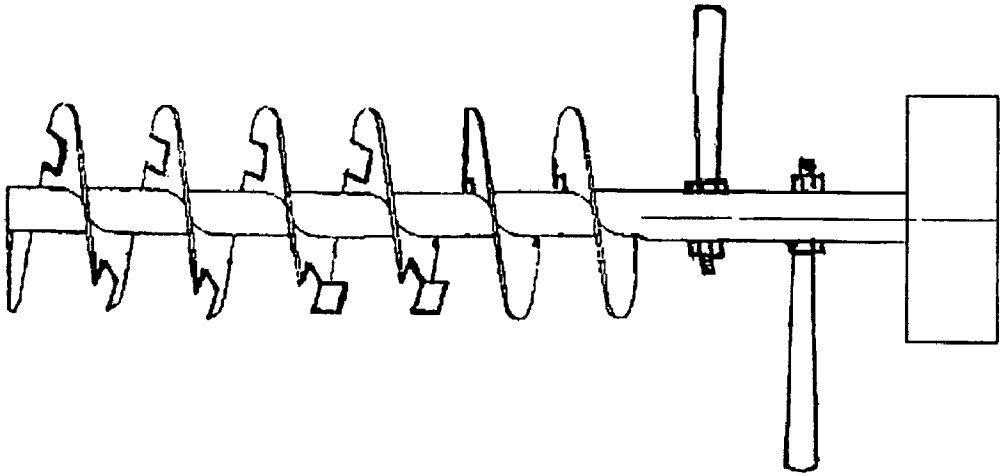
Figure 3J:
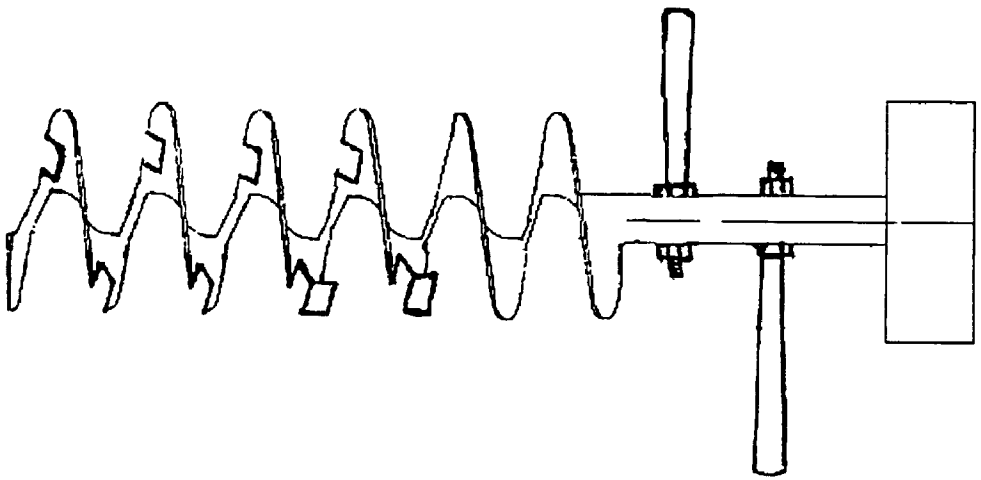

The wash chamber 12 may comprise one or more inlets for the introduction of the mixture comprising sand and organic material. FIG. 1 shows one example in which the inlet for the sand and organic material is a conduit 32 place along an inner wall of the wash chamber 12. FIG. 2 shows another example in which the inlet for the sand and organic material is a chute 102, which is inserted into open end 104 of the wash chamber 12.

The wash chamber also may have one or more outlets the removal of wastewater comprising water and organic material after the sand has been rinsed. FIG. 1 shows one example in which the outlet 30 is placed along an inner wall of the wash chamber 12 on one side of a weir 34. The weir 34 is an annular overflow, which extends from the wash chamber walls and acts as a barrier in which the wastewater with the organic materials flows over the top of the weir and then out of the one or more outlets 30 that are present. FIG. 2 shows an example in which the outlet 30 for the wastewater and organic material is placed along an inner wall of the wash chamber 12 without the weir 34. Alternatively, the embodiment of FIG. 2 could also have a weir 34 in combination with the inlet chute 102 for the introduction of sand and organic material.

The relative position between the one or more inlets for the sand and organic material and the one or more outlets for the wastewater and organic material will be explained. In FIG. 1, the inlet 32 for the sand and organic material may be placed below the weir so that the likelihood of the sand being swept away into the outlet 30 is decreased. In FIG. 2, the outlet for chute 102 extends below the level of the one or more outlets 30 for the wastewater and organic material for the same reason since the sand is more likely to sink into the lower part 12*b* of the wash chamber than to be carried by the water flow. If the outlet of the chute is placed above the outlet 30, a portion of the sand might be carried away with the wastewater and organic material. In another embodiment in which the chute 102 is used in conjunction with a weir 34 that projects out from the wall of the upper conical section 12*a* in the same fashion as in FIG. 1, the outlet 106 of chute 102 extends below the level of the weir so that the sand is more likely to enter into the lower part 12*b* of the wash chamber than flow out of the outlet 30 for the wastewater and organic material.

It is noted that FIGS. 1 and 2 show that the upper section 12*a* of the chamber 12 is a cone, which is a convenient way to provide residence time and to direct the sand into the small cylindrical section 12*b*. However, virtually any shape that provides enough volume to provide the necessary residence time is acceptable. Thus, the upper portion 12*a* of the wash chamber 12 could be reconfigured above the cylindrical portion 12*b* to allow for different shapes. Examples of other potential shapes include an upper section 12*a* with a cylinder and a connecting cone section for attachment to the cylindrical section 12*b* or the upper section can merely be a cylinder that attaches directly to the cylindrical section 12*b*. A further example is to have the upper and lower chambers 12*a* and 12*b* be boxes with a pyramid transition section between them. All these type of configurations would be considered to be in a shape of a funnel according the present application since there is any shape of the larger upper section 12*a* would be connected to any shape of the smaller lower section 12*b* through an opening 13.

The next basic component of interest is the agitator 18. FIG. 2 shows an example of one such agitator. At least a portion of the agitator 18 may be provided in the lower cylindrical section 12*b* of the wash chamber 12. The agitator 18 may be a stationary structure or may be connected to an agitator drive 20 supported on a support 26, which spans the opening 104 of wash chamber 12. The agitator drive 20 may comprise a motor 22 and a reducer 24. The motor 22 can be, for example, a variable speed motor. If the agitator 18 is configured to rotate, its rotation creates a lifting action tending to force at least a portion of sand descending through or already present in the cylindrical section 12*b* to flow in an upward direction.

The agitator 18 can be of various forms such as a screw, a shaft equipped with paddled arms, or a combination of both. For example, the agitator 18 can comprise a screw with a shaft as seen in FIG. 3(*a*), a shaftless screw as seen in FIG. 3(*b*), a shaft equipped with paddled arms as seen in FIG. 3(*c*) in which flat faces are positioned so as to impart an upward flow, or a combination of a screw with paddles as seen in FIG. 2. Other examples of the agitator are provided in FIGS. 3(*d*)-3(*j*).

In one embodiment, the agitator 18 can be a screw with a shaft 108 as seen in FIG. 2. The screw's pitch, flight outer diameter, and root diameter determine the cross-sectional area of the screw channel, which, in turn, determine the velocity of the water in the cylindrical section 12*b* as the water flows in a serpentine manner in the cylindrical section. All things being equal, the smaller the pitch, the faster the flow at a given volumetric rate. Changing the pitch changes the flow velocity so that the flow velocity can be changed by simply changing the screw configuration without having to modify the base unit. Because the screw is lifting the solids, it will also act as a pump to further increase the upward velocity of the water.

Additionally, since the rotating-type of agitator can be driven by a variable speed motor, the agitator speed can be made higher, and thus the force of the upward pumping and lifting effect can be increased. As a result, the shear forces that break up the organic material in the mixture will also be increased. In addition, the ability to adjust the rotating speed provides further flexibility so that the speed for the best washing can be optimized The rotating-type of agitator can be continuously rotated in a direction that pulls the sand upward. The upward pull of the agitator is mechanically safe in that the agitator cannot generate a compressive force. As sand emerges above the confines of the lower section 12*b*, it spills outward and falls downward creating a rolling torus. The constant turning over of the sand breaks loose and reduces the size of the sludge particles so that they can rise with the rinsing water flow.

Referring to FIGS. 2 and 3(*a*)-(*b*), if a screw is used as the agitator, it can have a series of flights 110, which can be two or more in number. These flights may be smooth flights such as flight 110(*a*), cut and folded flights such as flight 110(*b*), or may be merely cut flights (not shown), or may be any combination thereof. The cut and folded flights 110(*b*) are formed by a cut that runs from the outer flight diameter 112 towards a point 114 between the shaft 18 and the outer flight diameter 112. Another cut is formed from the point 114 to another point between the shaft 18 and the outer flight diameter 112 of the screw thread. These two cuts form a flap 118 that is folded at an angle from the screw thread. This fold may be upward toward the agitator drive 20 or downward toward the discharge opening 14. The cut and folded flights reduce the conveying efficiency of the screw so that some amount of sand leaks downward against the force of the screw. As the screw-type of agitator rotates, the cut flights and the folded tabs (or folded plates) become shear planes that break up agglomerates and scrubs sludge from the surface of the sand granules so that it can be lifted up by the water flow.

In another embodiment of the present invention, the agitator 18 may be a shaft 202 equipped with paddled arms 302 that have a face 206 attached to an arm shaft 208, as seen in FIG. 3(*b*). The faces are tilted at an angle off the vertical plane to create the necessary lift for the sand to turn over in the wash chamber 12. In addition, the paddled arms can be further characterized as having a predetermined or adjustable pitch. In general, the paddle arms can be in any configuration to generate the necessary lift of the sand particles, a uniform or a staggered configuration are examples. As mentioned above, the paddle arms can be used with other types of agitators.

In one embodiment as shown in FIG. 2, the paddles arms can be used in conjunction with the screw-type agitator to break up the lumps and prevent agglomeration. The pitched blades provide the function of preventing stratification and of reducing the tendency of the rising sludge to float out finer sand particles by gently turning the slurry over. pitch adjustability may allow the optimization of this function.

As previously-mentioned, other examples of the agitator are provided in FIGS. 3(*d*)-3(*f*). FIG. 3(*d*) shows an agitator 18 in the form of a wheel, which has spokes that are flat and pitched so as to impart an upward directional flow to the sand. Even though FIGS. 2 and 3(*a*)-(*c*) have agitators that rotate about a vertical axis, FIG. 3(*d*) shows a horizontal axis of rotation in which the motor for driving the wheel is not attached to the top of the upper section 12*a* of the wash chamber 12 but is actually attached to the side of the lower section 12*b*. Although FIG. 3(*d*) shows a counter-clockwise direction of rotation, the direction of rotation can be in either the clockwise or counter-clockwise direction since either direction would impart an upward flow to the sand along at least one side of wheel.

FIG. 3(*e*) shows another example of the agitator 18 in the form of paddles that move back and forth. This oscillation of the paddles would also impart an upward directional flow to the sand. Essentially, the paddles push the sand upward when they move forward, which is also in an upwardly direction, as indicated by the arrows. The paddles would swing back down and then swing out again in an upwardly direction to push more sand upward. The paddles of this embodiment could be any shape, such a rectangle or another type of polygon, and can project out of the inner circumferential wall of the lower section 12*b*. In addition, any number of rows or columns can be used, which can best optimize the separation process. Furthermore, the paddles can be in a staggered or irregular pattern along the inner surface of the lower section 2*b*.

FIG. 3(*f*) is another example of the agitator 18 in which a series of wheels similar to the wheel in FIG. 3(*d*) is used. As in the case of FIG. 3(*d*), these wheels have a horizontal axis of rotation. In addition, only a portion of each wheel protrudes out into the lower section 12*b* and each of the wheels is rotated in such a manner in which only the side that imparts an upward flow onto the sand is exposed to the sand in the lower section 12*b*. Furthermore, any suitable number, size, rotating speed, and configuration of wheels can be used, which would best optimize the separation process.

FIG. 3(*g*) is an example of the agitator 18 in the form a propeller, such as a marine and axial flow turbine that imparts a directional flow. Similar to FIG. 2 and unlike FIG. 3(*d*), the propeller has a vertical rotation of axis in which the motor can be placed on top of the wash chamber as shown in FIG. 1. One or more propellers can be used as the agitator. If more than one propeller is used, they may be stacked on top of each other or side by side, they may be aligned or staggered if they are stacked, and they may rotate at the same speed or at different speeds.

FIG. 3(*h*) shows another agitator in the form of an air assist with rising bubbles from one or more sparges or diffusers, which provide both lift and agitation. As in the other embodiments, the number, size, and configuration of the diffusers can be varied so that the optimum operating conditions of the apparatus can be obtained.

FIGS. 3(*i*) and 3(*j*) show other examples of agitators. FIG. 3(*i*) shows an agitator comprising a screw and a shaft equipped with paddled arms. FIG. 3(*j*) shows an agitator comprising a shaftless screw and a shaft equipped with paddled arms. Both agitators of FIGS. 3(*i*) and 3(*j*) comprise a screw having two or more flights, the flights further characterized as being a combination of smooth flights, cut flights, and cut and folded flights.

It should be noted again that any of these agitators shown in FIGS. 2 and 3(*a*)-(*h*) can be used in combination with each other. Furthermore, any of the agitators could be used with any suitable shape for the wash chamber. For example, any of the agitators shown in FIGS. 2 and 3(*a*)-(*h*) can be used with a lower section 12*b* that has a circular or rectangular cross-section.

Referring back to FIG. 1, the collection chamber 15 of the sand washing apparatus is positioned below the wash chamber 12 for collecting the sand that has descended past the cylinder. The discharge opening 14 of the wash chamber 12 leads to a collection chamber 15 positioned below the vertical chamber for collecting sand that has accumulated after being washed in the wash chamber. The collection chamber 15 is connected to a discharge conveyor 16.

The discharge conveyer 16 is used to transport sand away from the collection chamber. It may be a screw conveyor or other known type of conveyer. For example, the conveyer can be equipped with a spiral 36 without a shaft as shown in FIG. 1. In another embodiment, the conveyer may be equipped with spiral on a shaft. The conveyer may comprise an upwardly tilted chute 42 that carries the rinsed sand toward a conveyer opening 44 via spiral.

The spiral is driven by a conveyer motor 40, which may be operationally linked to the agitator motor 22 via a control module 46. When the inclined conveyer 16 is operating to remove the washed sand away from the collection chamber 15, a sensor 50 can detect any parameter that may be related to the removal rate of sand from the apparatus 10. The sensor 50 sends a measurement to the control module 46, which detects the signal and then sends a command to the agitator motor 22 to slow down or speed up to any desired speed based off this signal. This feature safeguards against the possibility of the agitator withholding sand from falling into the collection chamber 15 and preventing the removal of the washed sand from the unit. The higher the agitator speed, the greater possibility of the sand being withheld by the agitator.

The rinsed sand then exits the conveyor at the conveyer opening 44 and empties into a collection unit 19, which collects the washed sand.

The operation of the sand washing unit will now be explained. An example of the operation is given in FIG. 4. A mixture comprising sand and organic material, such as manure, is introduced into a wash chamber through one or more openings 102 (or 32 in FIG. 1) as indicated by arrow 302 in FIG. 4. The inlet for the sand and organic material can extend below the weir and/or the outlet for the wastewater to prevent the sand from directly entering the water outlet 30.

Figure 4:
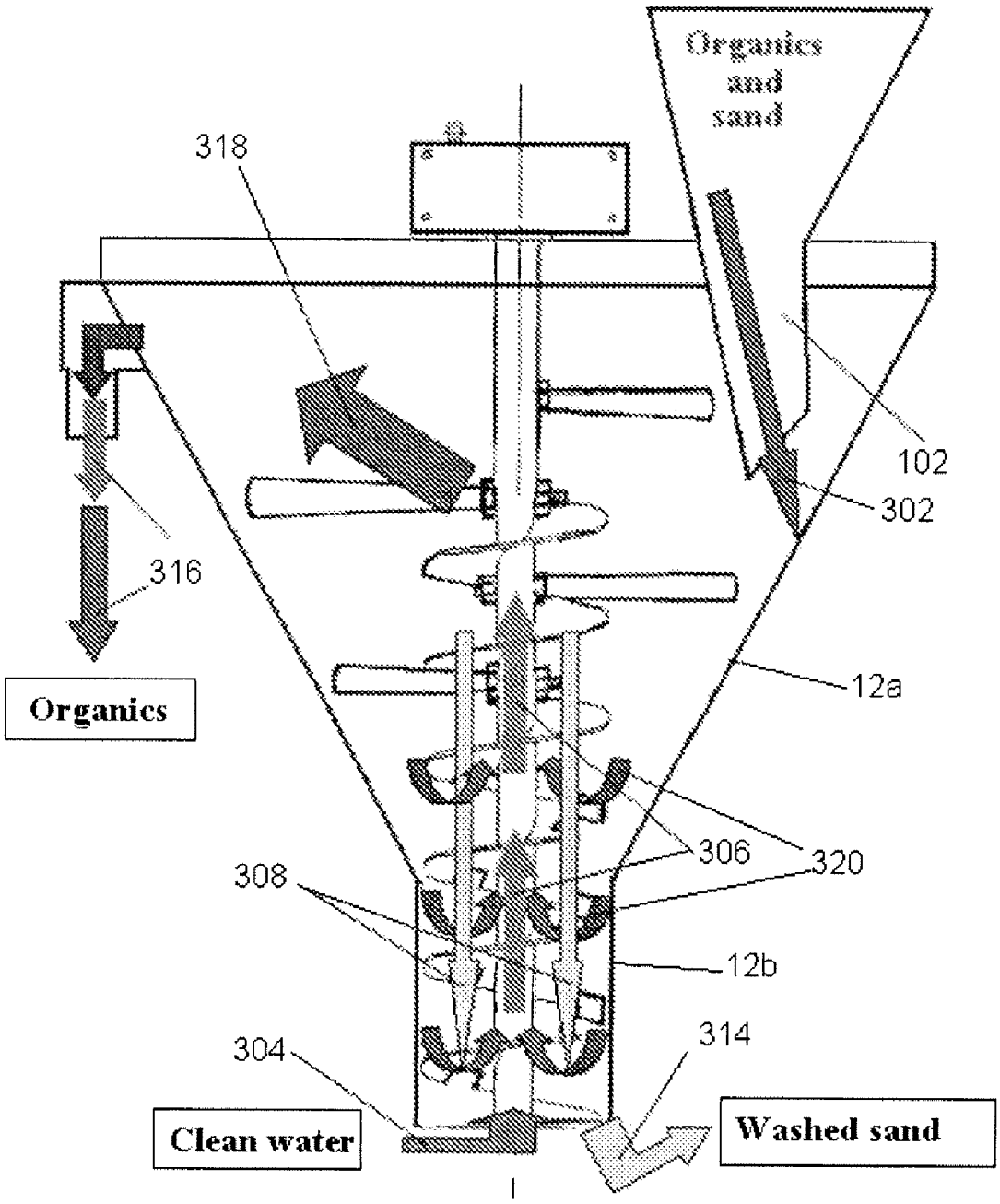
FIG. 4 shows the flow directions of the sand, organic material, and water during the sand washing process according to one embodiment of the present invention.

The wash chamber 12 is filled with water and the net flow of water is in an upwardly direction as fresh water enters through an inlet (such as inlet 28 in FIG. 1) and flows upward toward the upper conical portion 12*a* of the wash chamber 12, as indicated by arrow 304 in FIG. 4. The water may be forced to flow in a serpentine fashion due to the configuration of the agitator.

The sand tends to sink towards the lower chamber 12*b*. The organic material, which as a smaller specific gravity, will have a tendency to float with the water. The object is then to dislodge the organic material from the sand so that the sand will sink and the organic material will float with the water.

As the sand particles and the organic materials attached to the sand particles begin to sink towards the discharge opening 14, the fresh water flows upward. The interaction with the fresh water will cause the more loose organic materials to separate from the sand. Thus, the organic material from the mixture is allowed to ascend in a net upwardly direction with the flow of the water while the sand from the mixture is allowed to descend in a net downwardly direction due to gravity.

As the sand and any attached organic material enters into the lower cylindrical portion 12*b*, the sand and organic materials encounter the agitator. There are two forms of agitation that will be described: when the agitator rotates and when the agitator does not rotate.

In regards to the agitator that rotates, the spinning action of any of the various embodiments of the agitator causes a portion of the sand that contacts it to flow upward against the flow of gravity. For example, the flights of the screws and/or faces of the paddled arms impact the sand and the rotation of these flights and/or faces causes the sand to climb up the screw threads or paddled arms. This kind of movement is indicated by arrows 306 in FIG. 4. Thus, at least a portion of the descending sand is subjected to a turbulence generated by the agitator, which creates a lifting action tending to force the sand encountering the turbulence to flow at least temporarily in an upwardly direction.

As the sand emerges above the confines the lower cylindrical portion 12*b*, it spills outward and falls downward toward the discharge opening 14, thus creating a rolling torus. This kind of turbulence generated by the agitator creates additional impacts between the sand and other objects. For example, the sand granules with attached organic materials impact other sand granules, the paddles if paddled-arms are used in the agitator, the plates if a screw agitator with cut and folded flights is used, the smooth flights if a screw agitator is used, or a combination of any of these. These additional impacts will allow further opportunities for the sand and the organic material to be separated from each other. Thus, the impacting breaks up the agglomerates of sand granules and organic material and/or scrubs the organic material away from sand. As result, the organic material will then be carried away by the water as indicated by arrows 318 and 320 while the sand granules will have a tendency to sink.

As the sand and organic materials separate from each other due to the impacts with the agitator and other objects, the sand particles tend to sink toward the collection chamber 15 because of the gaps in the agitator. These gaps in the agitator include the cuts in the flights or the cuts and folds in the flights as in the case of the screw-type of agitator with a shaft, the center hole of the thread as in the case of the shaftless screw-type of agitator, or the gaps between the arms as in the case of the paddled arm-type of agitator. This kind of sand flow is indicated, for example, by arrows 308 in FIG. 4.

FIG. 4 shows an embodiment in which the turbulence caused by the agitator is positioned about the center axis of the chamber causing at least a portion of sand encountering the turbulence to flow in an upwardly direction 306 due to the threads of the screw while allowing at least a portion of sand not encountering the turbulence to flow in a downwardly direction 308 because of the gaps in the agitator, such as the cut and folded portions of the screw threads.

In the case of the non-rotating agitator, the sand will still have a tendency to sink due to gravity while the organic material has a tendency to float with the upward water flow. However, the impacts that cause the sand and organic material to dislodge would be due to stationary flights of the agitator, paddled arms of the agitator, and/or the water flow as opposed to moving flights or paddled arms.

As the sand flows downward, the rinsing water with organic material continues to flow upward toward the outlet for the water and the organic material. The organic material that is separated from the sand floats with the water flow and heads in the direction of the one or more outlet 318. This wastewater with organic material will exit the wash chamber either by flowing over the weir if one is present or by flowing in a more direct route if a weir is not present. Eventually, the organic material flows out with the wastewater, as indicated by the arrow 316. In contrast, the sand that descends past the agitator, and hence past the turbulence, is recovered through the use of the collection chamber 15. The sand may then be transported away from the collection chamber using the conveyer 16 and into the collection unit 19.

With the above-described apparatus and method for washing sand, a way has been provided to separate sand from organic materials for use in the cattle and dairy industry. The above method and apparatus performs its function without the need to maintain a minimum height of sand in the washing chamber. The reason is that there is no need for a sand cake to prevent the flow of organic materials from reaching the outlet used for discharging sand because the impacting of the sand through use of the invention described above provides a mechanism for dislodging the organic materials from the sand particles before they reach the outlet used for discharging the sand.

Although the above apparatus and method have been referred to as being related to the separation of sand and organic materials accumulated from the use of sand as bedding for animals, the apparatus and method can also have other uses as well, such as to wash grit in a municipal wastewater treatment system. Grit is a type of sand that is darker and coarser than that used as bedding. Grit is captured in traps, separators, or aerated chambers and when organics cling to the grit, the mixture has a foul odor and becomes difficult to landfill. By using one of the embodiments of the current application, the resulting grit can be made odorless and can easily meet the Paint Filter Test for economic landfill. Thus, the use of the term "sand" as used in the present application encompasses a variety of loose granular materials that results from the disintegration of rocks, such as the sand used in the dairy industry and grit as used in municipal wastewater treatment systems.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A sand washing apparatus for separating organic material from a mixture comprising sand and organic material, the apparatus comprising:

(a) a wash chamber in the shape of a funnel for accepting a mixture comprising sand and organic material, the chamber including a lower portion in the shape of a cylinder with an internal wall through which sand can descend in a downward direction and water can flow in an upward direction;

(b) an agitator at least some portion of which is positioned within the cylinder, which is configured so that its rotation creates a lifting action tending to force at least a portion of sand descending through or already present in the cylinder to flow in an upward direction;

(c) a collection chamber positioned below the wash chamber for collecting washed sand that has descended past the cylinder; and (d) a conveyor configured to transport sand away from the collection chamber, wherein the agitator comprises a screw having two or more flights, and a means for allowing at least a portion of sand to flow in the downward direction in the wash chamber within a perimeter of the agitator.

2. The sand washing apparatus of claim 1 in which the screw of the agitator is a shaftless screw.

3. The sand washing apparatus of claim 1 in which the flights are further characterized as being flights with a predetermined pitch, outer diameter, and root diameter.

4. The sand washing apparatus of claim 1 in which the agitator further comprises a shaft equipped with paddled arms, the paddled arms further characterized as having a predetermined or adjustable pitch.

5. The sand washing apparatus of claim 1 which further comprises a variable speed motor for driving the agitator.

6. The sand washing apparatus of claim 5 in which the conveyor is equipped with a shaftless spiral.

7. The sand washing apparatus of claim 6 in which the shaftless spiral is driven by a conveyor motor.

8. The sand washing apparatus of claim 7 which further comprises a control module that links the operation of the conveyor motor with speed of the variable speed motor.

9. The sand washing apparatus of claim 1 which further comprises one or more inlets for the introduction of water.

10. The sand washing apparatus of claim 1 which further comprises one or more inlets for the introduction of the mixture comprising sand and organic material.

11. The sand washing apparatus of claim 10 which further comprises one or more outlets for the removal of wastewater comprising water and organic material.

12. The sand washing apparatus of claim 11 in which the one or more inlets comprises one or more chutes the ends of which extend below the level of the one or more outlets.

13. The sand washing apparatus of claim 10 which further comprises a weir for the removal of wastewater comprising water and organic material.

14. The sand washing apparatus of claim 13 in which the one or more inlets comprises one or more chutes the ends of which extend below the level of the weir.

15. The sand washing apparatus of claim 1 in which the means for allowing at least a portion of sand to flow in the downward direction in the wash chamber comprises cuts and folds formed in the flights formed by a first cut on a screw thread that runs from an outer flight diameter of the screw towards a first inner endpoint between a shaft on which the screw is mounted and the outer flight diameter and a second cut on the screw thread that runs from the first inner endpoint to a second inner endpoint between the shaft and the outer flight diameter in which the first and second cuts form a flap that is folded at an angle from the screw thread.

16. The sand washing apparatus of claim 1 in which the means for allowing at least a portion of sand to flow in the downward direction in the wash chamber comprises cuts in the flights and cuts and folds in the flights.

17. A method of recovering sand from a mixture comprising sand and organic material comprising:

(a) introducing a mixture comprising sand and organic material into a water-filled chamber having a net flow of water in an upwardly direction;

(b) allowing organic material from the mixture to ascend in a net upwardly direction and allowing sand from the mixture to descend in a net downwardly direction;

(c) subjecting at least a portion of the descending sand to a turbulence that creates a lifting action tending to force sand encountering the turbulence to flow at least temporarily in an upwardly direction in which the turbulence is generated by an agitator comprising a screw having two or more flights and a means for allowing at least a portion of sand to flow in a downwardly direction in the wash chamber within a perimeter of the agitator; and (d) recovering sand that has descended past the turbulence.

18. The method of claim 17 which further comprises transporting the recovered sand away from the water-filled chamber.

19. The method of claim 17 in which the turbulence is positioned about the center axis of the chamber causing at least a portion of sand encountering the turbulence to flow in an upwardly direction while allowing at least a portion of sand not encountering the turbulence to flow in a downwardly direction.

20. The method of claim 17 in which the agitator further comprises a shaft equipped with paddled arms.

21. The method of claim 17 in which the step of subjecting at least a portion of the descending sand to a turbulence includes impacting granules of sand mechanically against another object, including other sand granules, paddles, plates, flights, or combinations thereof.

22. The method of claim 21 in which the impacting breaks up agglomerates of sand granules and organic material.

23. The method of claim 21 in which the impacting scrubs organic material away from sand.

* * * * *